United States Patent [19]

Markov et al.

[11] Patent Number: 4,919,033

[45] Date of Patent: Apr. 24, 1990

[54] ELECTRIC VIOLIN

[75] Inventors: Alexander Markov, Rowayton, Conn.; James Remington, Jamaica Estates, N.Y.

[73] Assignee: Alexander Markov, Rowayton, Conn.

[21] Appl. No.: 293,313

[22] Filed: Jan. 4, 1989

[51] Int. Cl.[5] ..... G10H 3/18

[52] U.S. Cl. ..... 84/726; 84/744; 84/DIG. 30

[58] Field of Search ..... 84/1.04, 1.06, 1.14–1.16, 84/274, 275, 290, 291, 293, 307, 309, 312 R, DIG. 30, 723, 725, 726, 743, 744

[56] References Cited

U.S. PATENT DOCUMENTS

| | | | |
|---|---|---|---|
| 858,587 | 7/1907 | Ehlenz . | |
| 2,978,495 | 4/1961 | Dopera et al. | 84/1.15 |
| 3,788,183 | 1/1974 | Mariner | 84/291 |
| 4,051,761 | 10/1977 | Nylen | 84/1.15 |
| 4,305,320 | 12/1981 | Peavey | 84/1.16 |
| 4,334,452 | 6/1982 | Morrison et al. | 84/1.16 |
| 4,425,831 | 1/1984 | Lipman | 84/1.16 |

*Primary Examiner*—Stanley J. Witkowski

*Attorney, Agent, or Firm*—St.Onge Steward Johnston & Reens

[57] ABSTRACT

The invention presented consists of an electric violin having (a) a body shaped so as to have a fingerboard indentation along an upper end in a location to the right of a fingerboard extending therefrom; a first bow indentation along a right side; an arcuate-shaped lower end; and a second bow indentation along a left side; (b) a fingerboard having a lower portion mounted on the body and an upper portion extending from an upper end of the body, the fingerboard having sufficient width to accomodate a plurality of strings (c) a head disposed on the end of an upper portion of the fingerboard, the head having a plurality of pegs, each corresponding to a string; (d) a plurality of strings, each removably attached to the body, extending along the fingerboard and removably attached to each of the pegs on the head; and (e) a magnetic pickup associated with the body and having an upper portion mounted on the body so as to be operatively connected with each of the plurality of strings and a lower portion mounted in the body capable of providing sounds to a suitable amplification means.

20 Claims, 3 Drawing Sheets

ELECTRIC VIOLIN

TECHNICAL FIELD

The present invention relates to a unique electric violin having a sound and physical appearance which differs substantially from anything previously found on conventional violins. The revolutionary sound and appearance of the inventive electric violin is far better suited to the playing of popular (or "rock") music than prior art violins. The electric violin of this invention generally comprises a body shaped so as to comprise a fingerboard indentation along an upper end in a location to the right of a fingerboard extending therefrom; a first bow indentation along a right side; an arcuate-shaped lower end; and a second bow indentation along a left side. The violin further comprises a fingerboard having a lower portion mounted on the body and an upper portion extending from an upper end of the body, the fingerboard having sufficient width to accommodate a plurality of strings; the inventive violin also comprises a head disposed on the end of an upper portion of the fingerboard, the head comprising a plurality of pegs, each corresponding to a string; moreover, the claimed violin is comprised of a plurality of strings, each removably attached to the body, extending along the fingerboard and removably attached to each of the pegs on the head; and a magnetic pickup associated with the body and having an upper portion mounted on the body so as to be operatively connected with each of the plurality of strings and a lower portion mounted in the body capable of providing sounds to a suitable amplification means.

Classical violins can generally be described as stringed instruments played with a bow, having four strings tuned at intervals of a fifth and having an unfretted fingerboard. Violins are known as being capable of great flexibility in range, tone and dynamics. Attempts to modify classical violins for the playing of amplified music, however, have not met with much success. The existing designs and sounds of standard amplified violins do not generally fit the style of music which is most often amplified, namely popular or "rock" music. The shape and sound of these amplified violins closely mimics that of their classical cousins, and are hardly capable of adequately serving their intended function. These modified classical violins do not create the appropriate sound or image for the playing of "rock" music, especially since the sound created is weak and shallow, and can be described as "squeaky", especially when compared to the other instruments used in performing "rock" music, such as the electric guitar, the electric bass guitar, the synthesizer, the drums, etc. Moreover, the very shape of these traditional electric violins has been found to be disadvantageous in many respects, in that free hand and bow movement is often restricted, resulting in a more difficult instrument to play certain types of music.

What is desired, therefore, is an amplified violin which conveys a modern and sophisticated impression, in terms of both sound and appearance. The desired violin creates more of a "rock" electric sound and provides a desired "rock" image. Unfortunately, such desired characteristics are not present in any prior art violin.

DISCLOSURE OF INVENTION

The invention presented herein generally comprises an electric violin comprising (a) a body having an upper end, a right side having upper and lower portions, a lower end and a left side having upper and lower portions, the body shaped so as to comprise a fingerboard indentation along the upper end in a location to the right of a fingerboard extending therefrom; a first bow indentation along the right side; an arcuate-shaped lower end; and a second bow indentation along the left side; (b) a fingerboard having an upper portion and a lower portion, the lower portion mounted on the body and the upper portion extending from the upper end of the body, the fingerboard having sufficient width to accommodate a plurality of strings; (c) a head disposed on the end of the upper portion of the fingerboard, the head comprising a plurality of pegs, each corresponding to a string; (d) a plurality of strings, each removably attached the body, extending along the fingerboard and removably attached to each of the pegs on the head; and (e) a magnetic pickup connectively associated with the body and having an upper portion mounted on the body so as to be operatively connected with each of the plurality of strings to receive sounds therefrom and a lower portion mounted in the body capable of providing the sounds to a suitable amplification means.

BRIEF DESCRIPTION OF THE DRAWINGS

The present invention will be better understood and its advantages more apparent in view of the following detailed description, especially when read with reference to the appended drawings, wherein.

DETAILED DESCRIPTION OF THE PREFERRED EMBODIMENT

Figure 1:
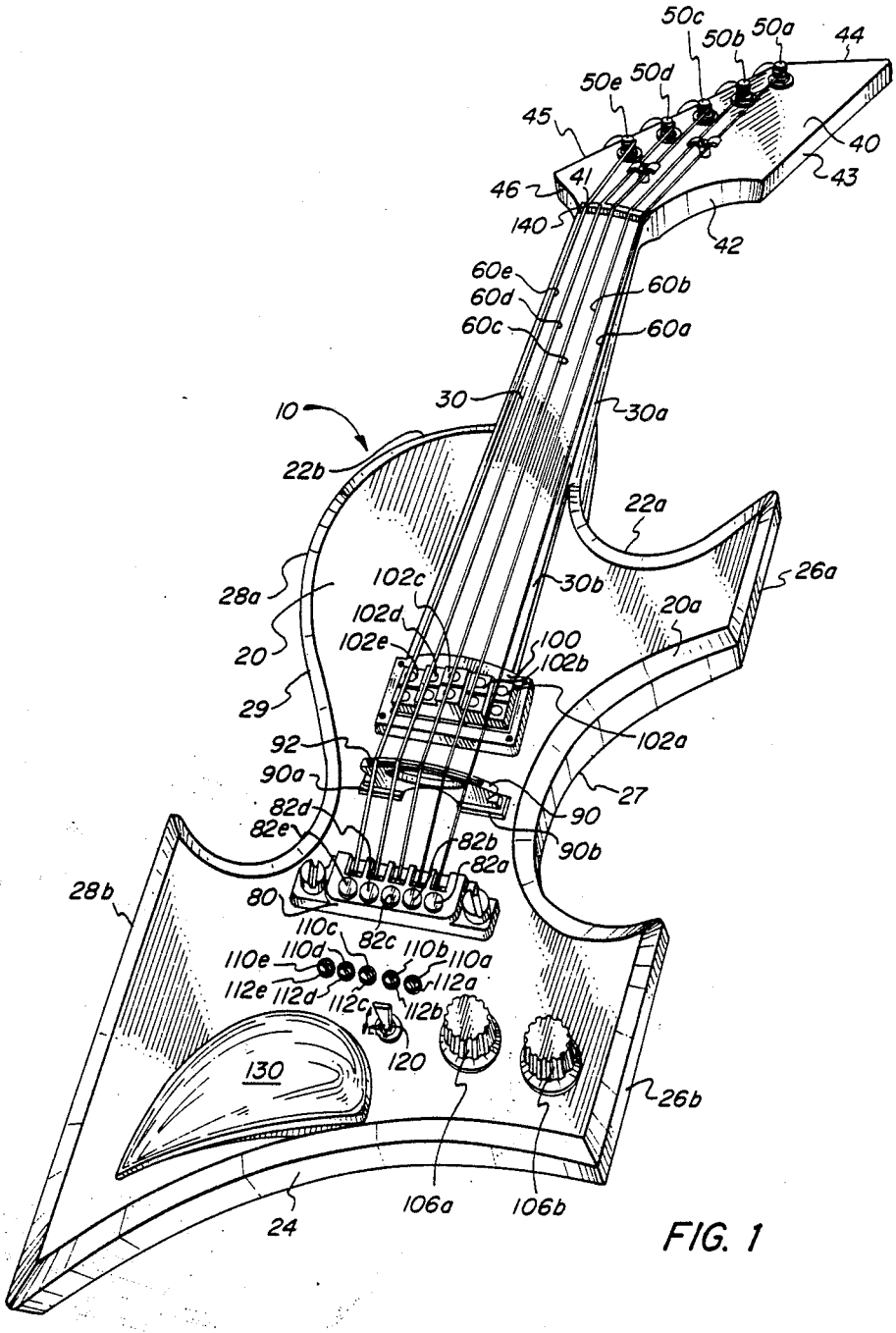
FIG. 1 is an isometric top view of one embodiment of the electric violin of the present invention.

Referring to the drawings, an electric violin, in accordance with the invention, is generally indicated by the reference numeral 10. It should be noted that for the sake of clarity all of the components and parts of electric violin 10 are not shown and/or marked in all of the drawings. Moreover, as used in this description, the terms "top", "bottom", "upper", "lower", "right", "left", etc. refer to electric violin 10 when in the orientation illustrated in FIG. 1. It will be understood, however, that electric violin 10 can assume many different orientations when in use. It will be further understood that, although electric violin 10 of this invention will be described as having a "right" side and a "left" side, such is for the sake of convenience and ease of description only and mirror image embodiments are also contemplated herein.

As illustrated in FIGS. 1–4, electric violin 10 generally comprises a body 20, body 20 having four sides or ends: an upper end 22, a lower end 24, a right side 26 and a left side 28. Both right side 26 and left side 28 have upper and lower portions. Right side 26 has right side upper portion 26*a* and right side lower portion 26*b*; and left side 28 has left side upper portion 28*a* and left side lower portion 28*b*. In addition, upper end 22 has two sides: upper end right side 22*a* and upper end left side 22*b*, which are separated by a fingerboard 30, discussed in more detail below.

Body 20 can be made out of any material suitable for formation of a violin or other electric stringed instrument. Advantageously, body 20 is made of a wood, preferably mahogany, which is most preferably solid, for its sound quality. Although the typical wood combination for electric solid-bodied instruments, mahogany with maple on top, can be utilized, the harsh sound and heaviness of the resulting violin make such a combination undesirable.

The circumferential top edge of body 20, especially when formed of solid mahogany, can advantageously be formed with a "beveled" top 20*a* in order to provide ornamentation and an aesthetically pleasing appearance. Additionally, body 20 can be, but is not necessarily, painted or otherwise colored with any commonly known material for coloring mahogany, and the particular color chosen is not significant. It may be desired, though, that body 20 is shiny and pearl white in color, most preferably with a platinum "sheen", for the iridescent and particularly attractive appearance created thereby, especially when electric violin 10 is used under a spotlight during a public performance. Although the size of body 20 is not critical, in the preferred embodiment, body 20 has a width between right side upper portion 26*a* and left side upper portion 28*a* of about 8 inches to about 10 inches, most preferably about 9 inches; a width between right side lower portion 26*b* and left side lower portion 28*b* of about 9 inches to about 11 inches, most preferably about 9.9 inches; and a thickness, 20*b*, of about 1 inch to about 1.5 inches, most preferably about 1.25 inches.

Upper end right side 22*a* of body 20 is generally configured as an indentation, as illustrated in FIG. 1. In other words, upper end right side 22*a* is shaped so as to be generally concave to provide such configuration. Besides the aesthetic advantages of an indented appearance, the shape of upper end right side 22*a* provides more space for maneuvering of the left hand of the individual playing electric violin 10, thereby providing greater comfort, flexibility and reach, especially when playing in the upper positions, which permits the player to be able to finger, or play notes, over a major portion of a fingerboard, unlike the limited space available on conventional violins. Hence, the indentation of upper end right side 22*a* can be referred to as a fingerboard indentation.

Right side 26 of body 20 comprises a first bow indentation 27 located at a point along right side 26 approximately midway between right side upper portion 26*a* and right side lower portion 26*b*. First bow indentation 27, as illustrated in FIG. 1, assumes a skewed arcuate shape. A skewed arcuate shape can also be described as being of generally concave orientation with a certain "handedness", i.e., a leaning in one direction or another. First bow indentation 27 is much larger than on conventional violins and is sized to allow the player of electric violin 10 to move the bow hand through fingerboard indentation 27, which permits greater space for movement of the bow, providing improved comfort and flexibility. In order to accomplish this, the opening of first bow indentation 27 should be at least about 3 inches wide, more preferably 4 inches wide or greater, in order to accommodate the bow hand.

Advantageously, right side upper portion 26*a* of right side 26 of body 20 generally comprises a relatively narrow extension, as illustrated in FIG. 1, formed between the indentations which comprise upper end right side 22*a* and first bow indentation 27. Right side upper portion 26*a* in this fashion provides a more modern or "rock" appearance to electric violin 10. Right side lower portion 26*b* is also preferably formed to provide a modern or "rock" appearance, as illustrated.

Lower end 24 of body 20 is generally shaped in a sweeping curve, or a wide arc. In this way, lower end 24 provides more comfort to the violinist by permitting electric violin 10 to rest comfortably on the player's shoulder, instead of the rounded design of "classical" violins, which can force the chin and neighboring muscles to tighten, often leading to discomfort and cramps. The cutaway arc of lower end 24 also provides a violin which weighs less than it might otherwise with a rounded lower end, thereby being easier to maintain in position for playing, especially over an extended period of time.

Left side 28 of body 20 also comprises an indentation, second bow indentation 29, located at a point along left side 28 approximately midway between left side upper portion 28*a* and left side lower portion 28*b*. Second bow indentation 29, as illustrated in FIG. 1, also assumes a skewed arcuate shape. As was the case with first bow indentation 27, second bow indentation 29 permits greater space for movement of the bow used to play electric violin 10, providing improved comfort and flexibility. Advantageously, the opening of second bow indentation 29 should also be at least about 3 inches, most preferably at least about 4 inches wide.

Preferably, as illustrated in FIG. 1, left side upper portion 28*a* of left side 28 of body 20 generally comprises a curved or arcuately-shaped portion, which extends from second bow indentation 29 and continues, and is most preferably integral with, upper end left side 22*b*. Left side upper portion 28*a* (advantageously with upper end left side 22*b*) in this fashion provides a smoother and more modern or "rock" appearance to electric violin 10. Left side lower portion 28*b* is also preferably formed to provide a modern or "rock" appearance, as illustrated.

Electric violin 10 further comprises an unfretted fingerboard 30 having an upper portion 30*a* and a lower portion 30*b*. Lower portion 30*b* of fingerboard 30 is secured to or mounted on body 20. Upper portion 30*a* extends beyond upper end 22 of body 20. Proportionally, lower portion 30*b* and upper portion 30*a* each generally comprise about half of fingerboard 30. In this way, the player has access to strings along fingerboard 30 to a sufficient extent to permit playing of electric violin 10. The lower end of lower portion 30*b* of fingerboard 30 terminates on body 20 between about one-third to one-half of the length of body 20 down from upper end 22.

Fingerboard 30 is most preferably made of ebony (but can, in fact, be made of any material suitable for a violin fingerboard) and is wide enough to accommodate a plurality of strings disposed across it. Advantageously, fingerboard 30 is wider than conventional fingerboards, since it must accommodate five strings, as discussed in more detail below. Standard violins only have four strings. Moreover, fingerboard 30 is longer than standard fingerboards in a manner proportionate to the larger size of electric violin 10 as compared to standard violins.

Figure 2:
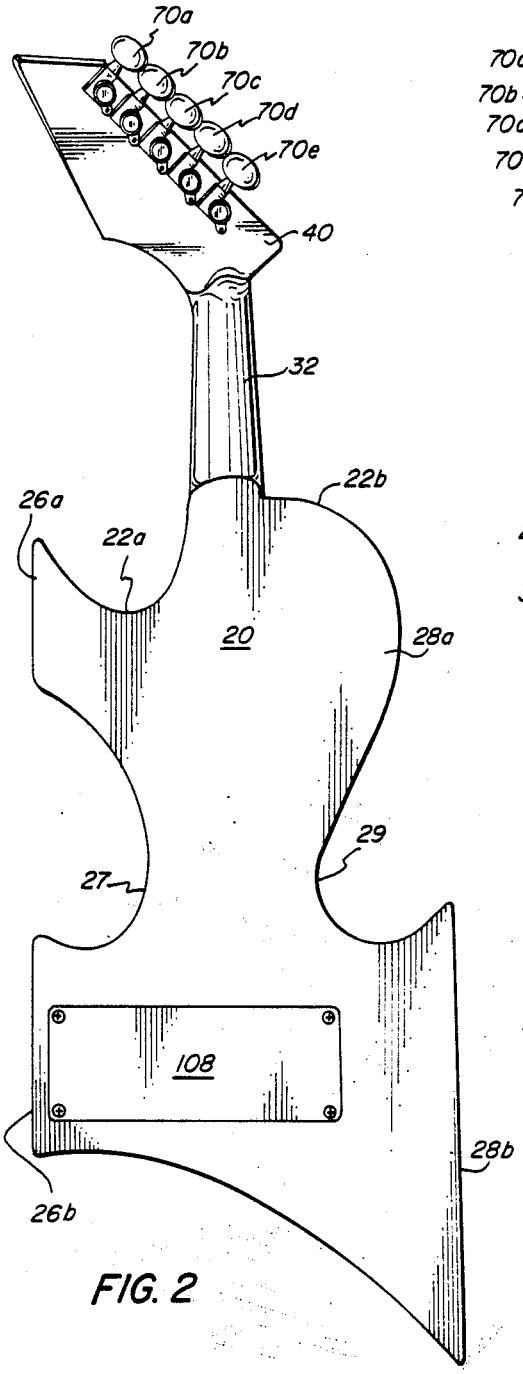
FIG. 2 is a bottom plan view of the electric violin of FIG. 1.
Figure 3:
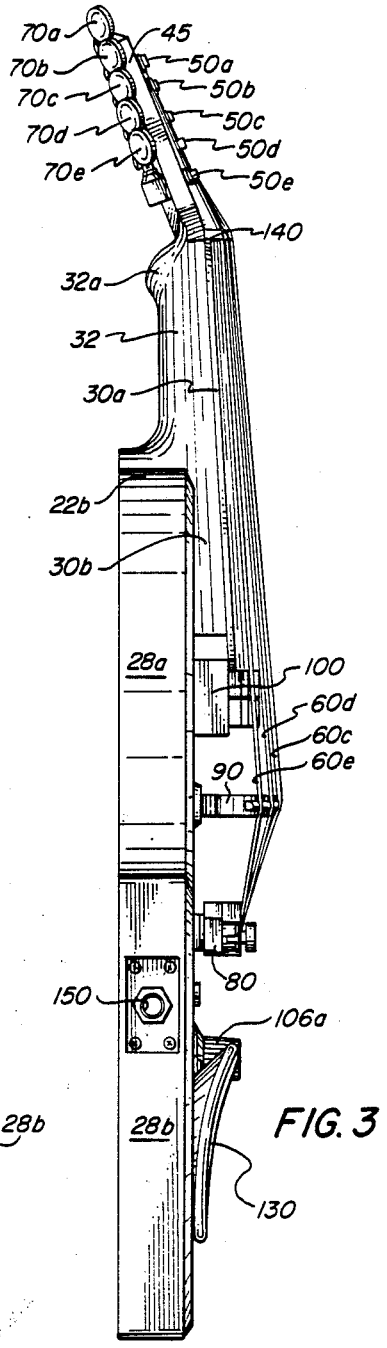
FIG. 3 is a left side plan view of the electric violin of FIG. 1.
Figure 4:
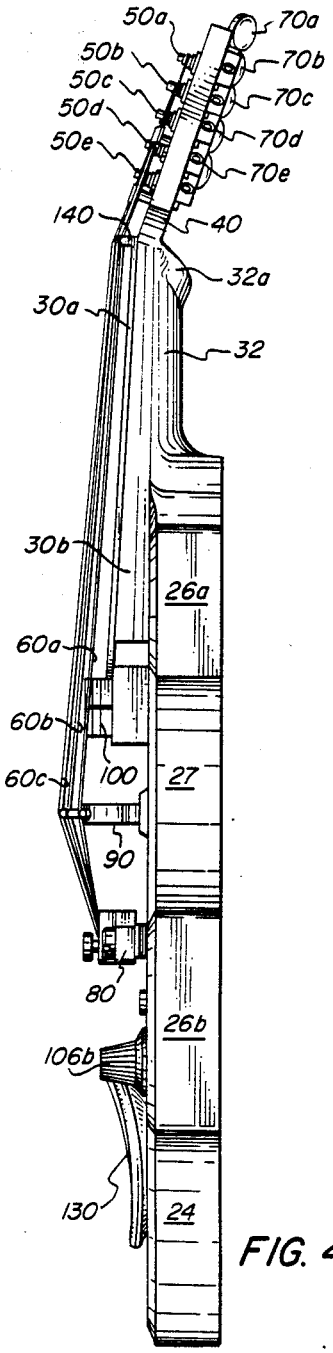
FIG. 4 is right side plan view of the electric violin of FIG. 1.
Figure 5:
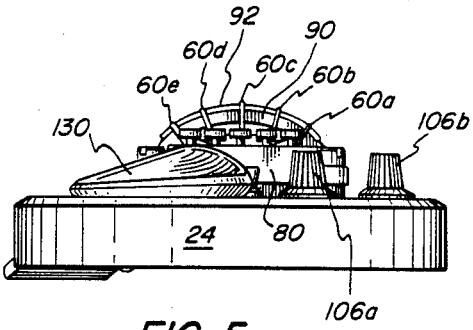
FIG. 5 is a bottom plan view of the electric violin of FIG. 1.

Advantageously, as illustrated in FIGS. 2–4, upper portion 30*a* of fingerboard 30 is supported by a neck 32 which extends from upper end 22 of body 20 and on which upper portion 30*a* of fingerboard 30 lies. Neck 32 is most advantageously formed of the same material out of which body 20 is made, and can be formed either integrally with body 20 or formed separately and attached to body 20 by known methods. Preferably, neck 32 comprises a block 32*a* which extends outward therefrom (or downward when electric violin 10 is held in common playing position), as illustrated in FIGS. 3 and 4. Block 32*a* functions to prevent playing of electric violin 10 beyond its lowest position.

Electric violin 10 also comprises a head 40, which is disposed on the terminal end of upper portion 30*a* of fingerboard 30 (and neck 32). The materials which can be used to form head 40 include any known in the art of "classical" violins, as well as any other materials suitable for this purpose. Head 40 further comprises a plurality of pegs 50, each corresponding to one of a plurality of strings. Head 40 is preferably hexagonal in shape with a first side 41 mounted on upper portion 30*a* of fingerboard 30; a second side 42 adjacent first side 41, second side 42 advantageously comprising an arcuate indentation relative to the hexagon formed by head 40; a third side 43 adjacent second side 42, third side 43 extending in a relatively straight line at an obtuse angle relative to fingerboard 30; a fourth side 44 adjacent third side 43, fourth side 44 extending in a relatively straight line at an acute angle relative to third side 43; a fifth side 45 adjacent fourth side 44, fifth side 45 extending in a relatively straight line at an obtuse angle relative to fourth side 44; and a sixth side 46 adjacent and between fifth side 45 and first side 41, sixth side 46 comprising an arcuate indentation relative to the hexagon formed by head 40. The precise angular and physical relationships of the sides of head 40 which comprises the most preferred embodiment of head 40 can most easily be understood by reference to FIG. 1.

Besides the apparent aesthetic reasons for forming second side 42 and sixth side 46 of head 40 as arcuate indentations, an additional (and more important) reason for doing so is to allow more space to avoid head 40 being struck by the left hand of the individual playing electric violin 10, when playing in the lower positions.

As noted above, the size of electric violin 10 is not critical to practice of this invention, but in the preferred embodiment, the length of electric violin from the top of head 40 to the lowest point of lower end 24 is about 30 inches to about 35 inches, most preferably about 32.25 inches.

As illustrated in FIGS. 1 and 3–6, electric violin 10 further comprises a plurality of strings 60, preferably five strings 60*a–e*. Strings 60*a–e* are removably attached to body 20 at a point below lower end 30*b* of fingerboard 30, extend along fingerboard 30 and are removably attached, respectively, to each of pegs 50*a–e* on head 40. The removable attachment of strings 60*a–e* to body 20 and pegs 50*a–e* is important since it permits the user to change any of strings 60*a–e* if one breaks or for other reasons familiar to the skilled artisan.

Strings 60*a–e* are made of steel, for use with magnetic pickup, discussed in more detail below. Strings 60*b–e* (i.e., all strings except for the highest in pitch) are advantageously viola strings, since viola strings are thicker and stronger, longer in length and more reliable, and therefore create a thicker and more powerful sound as compared to standard violin strings at the same pitch. Most preferably, strings 60*a–e* are tuned in fifths, with the highest four strings tuned precisely as in a conventional violin. For example, string 60*a*, the highest string, is pitched at "E"; string 60*b*, a fifth down, is pitched at "A"; string 60*c* is pitched at "D"; and string 60*d* is pitched at "G". The fifth string, 60*e*, is advantageously pitched at "C", tuned exactly like the lowest string on the viola. This varies strikingly from conventional violins and provides a lower range of sounds, with more depth and variety, than available on prior art violins.

Figure 6:
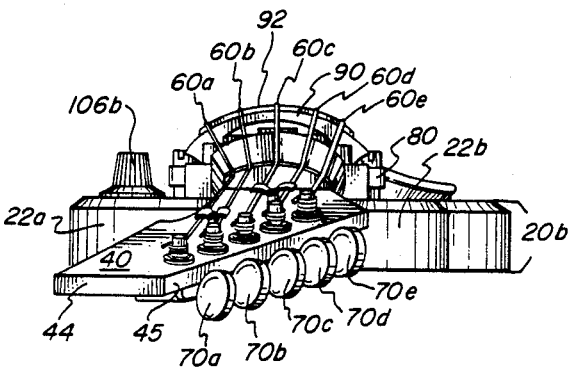
FIG. 6 is an upper end plan view of the electric violin of FIG. 1.

Pegs 50*a–e* are each used for gross tuning of each of strings 60*a–e*, as would be familiar to the skilled artisan. Pegs 50*a–e* tune strings 60*a–e* by tightening or loosening strings 60*a–e*. This is accomplished by turning pegs 50*a–e*, most advantageously through the agency of peg-rotators 70*a–e*, as illustrated in FIG. 6. Peg-rotators 70*a–e* can be made of any conventional material, such as ebony, and can even be standard guitar pegs.

In a preferred embodiment, electric violin 10 further comprises a stop-tailpiece 80 mounted or disposed on body 20, as illustrated in FIGS. 1, 3 and 4. Advantageously, strings 60*a–e* are removably attached to body 20 by being removably attached to stop-tailpiece 80, which in turn is securely attached to body 20. Stop-tailpiece 80 is preferably more streamlined and "modern" looking than conventional violin stop-tailpieces, in order to project the desired image and also to take up less space. Stop-tailpiece 80 can be formed of any conventional material, but is preferably made of steel with gold overlay for durability and aesthetics.

Stop-tailpiece 80 advantageously comprises a plurality of fine-tuning knobs 82*a–e*, each corresponding to one of strings 60*a–e*. Fine tuning knobs 82*a–e* function to permit fine tuning (such as by rotating by hand or other suitable means) of strings 60*a–e* after gross tuning using pegs 50*a–e*.

As illustrated in FIGS. 1, 3 and 4, electric violin 10 most preferably also comprises a bridge 90, most preferably made of ebony with an ivory top (although other materials known as being suitable for a violin bridge can also be employed), which is mounted or disposed on body 20 at a point between stop-tailpiece 80 (or wherever strings 60*a–e* are removably attached to body 20) and lower portion 30*b* of fingerboard 30. In fact, bridge 90 must be disposed at a point between stop-tailpiece 80 and magnetic pickup 100, discussed in more detail below. Bridge 90 is designed so as to be proportional in size to electric violin 10. In other words, since electric violin 10 most preferably has five strings, 60*a–e*, bridge 90 should be wider than conventional bridges, in order to accommodate the additional string. In a preferred embodiment, bridge 90 is taller than its predecessors, and has larger platforms, 90*a* and 90*b*, for firmer balance and to provide more secure attachment to body 20. Moreover, the opening in bridge 90 is larger than in conventional violins to provide better views.

Bridge 90 serves to force strings 60*a–e* into tension and maintain them in a position wherein they do not press down against any portion of fingerboard 30 with substantial pressure, as this would interfere with the ability to play electric violin 10 or the quality of sound achieved. Bridge 90 accomplishes this via bridge top 92, which tends to force strings 60*a–e* in a direction away from body 20. The action of bridge 90 also tends to arrange strings 60*a–e* in an arcuate distribution so that string 60*c* is oriented higher than any of strings 60*a*, 60*b*, 60*d* and 60*e*. Similarly, strings 60*b* and 60*d* are each oriented higher than either of strings 60*a* and 60*e*. In this way, the bow is able to play strings 60*a–e* individually, as opposed to all strings at once as would be the case if strings 60*a–e* were all oriented in the same plane.

Electric violin 10 further comprises a magnetic pickup 100 which functions to as accurately as possible transduce the motion of strings 60*a–e* into corresponding electrical signals, advantageously as faithfully and with the highest fidelity possible. The electrical signals are then provided to a suitable sound amplification means, as is conventionally known. Magnetic pickup 100 is preferred to piezo pickups which are generally used on standard electric violins because piezo pickups provide a "squeaky", unrefined sound and can create a sudden "feedback" since they are usually used with hollow violins and cannot accommodate a large volume of sound when used near an amplifier. Additionally, piezo pickups lead to more of an "acoustic" type sound, as opposed to the more "electric" sound desired herein. Magnetic pickup 100, on the other hand, picks up the vibrations of each of strings 60*a–e* individually unlike a piezo pickup and provides a sustained, thick and deep sound, i.e., one that is ideal for the playing of "rock" music. Moreover, magnetic pickup 100 does not create feedback since it is used on a solid-bodied violin and it permits the execution of chords and sequences of chords in a manner far superior to that of piezo pickups.

Magnetic pickup 100 comprises an upper portion 102 which is mounted or disposed on body 20 by conventional means and is in operative connection with each of strings 60*a–e*. By operative connection is meant that upper portion 102 of magnetic pickup 100 comprises a plurality of pickup elements 102*a–e*, as illustrated in FIG. 1, each of which corresponds to and is responsible for "picking up" the vibrations of one of strings 60*a–e*. Pickup elements 102*a–e* are arranged in a "step-wise" arcuate distribution, i.e., so that element 102*c*, in the middle, is raised higher than any of elements 102*a*, 102*b*, 102*d* and 102*e*, and elements 102*b* and 102*d* are each raised higher than either of elements 102*a* and 102*e*. In this way, each of pickup elements 102*a–e* is brought into proximity with its corresponding of strings 60*a–e*, which, as noted above, are also arranged in an arcuate distribution.

Magnetic pickup 100 also comprises a lower portion 104 (not shown) which is disposed inside body 20, with access thereto advantageously being through plate 108, as illustrated in FIG. 2. Lower portion 104 of magnetic pickup 100 comprises means capable of providing sounds generated by playing of electric violin 10 to a suitable amplifying means (not shown) through an electric cord (not shown) inserted into socket 150 (FIG. 3). Preferably, lower portion 104 of magnetic pickup 100 comprises an active electronics preamp/filter module, which intensifies and modifies the sound even more. Most advantageously, lower portion 104 of magnetic pickup 100 further comprises means, such as a trimpot, to set the gain as well as a frequency control which tunes an active low-pass filter section to adjust the tone coloration, thereby providing a wide range of usable "natural sounding" tonal effects. Each of the gain means and tone coloration means can be manually adjusted by the user, most preferably by adjustment of master volume control knob 106*a* and tone and treble control knob 106*b*, respectively, which extend onto the surface of body 20.

Advantageously, magnetic pickup 100 is formed with a gold overlay, for the durability and aesthetic benefits provided by such a appearance.

Optionally, electric violin 10 can also comprise individual volume controls 110*a–e*, corresponding to each of strings 60*a–e* and operatively connected to lower portion 104 of magnetic pickup 100. Individual volume controls 110*a–e*, as illustrated in FIG. 1, serve to provide the player of electric violin 10 with means for individually controlling the volume of each string 60*a–e*. In this way, a desired volume balance and musical effect can be achieved. Individual volume controls 110*a–e* can be wired into lower portion 104 of magnetic pickup 100 by conventional means, and can be adjusted by conventional means, such as by screwdriver. Most preferably, individual volume controls 110*a–e* have rings of gold overlay 112*a–e* surrounding them for aesthetics.

In an advantageous embodiment, electric violin 10 further comprises a tone boost switch 120, as illustrated in FIG. 1, which is disposed on body 20 and connectively associated, most preferably by being wired into, lower portion 104 of magnetic pickup 100. Tone boost switch 120 comprises any conventional switch having two positions, such as a toggle switch. One of the positions of tone boost switch 120 is a normal position and the other provides tone boost at the roll-off point, as would be familiar to the skilled artisan. Tone boost switch 120 provides the opportunity to the player of electric violin 10 to create tone boost if and when desired by simply moving tone boost switch 120 from one position to another.

As illustrated in FIG. 1, electric violin 10 also comprises a chinrest 130, proportionately larger than those used in conventional violins because of the larger size of electric violin 10. Chinrest 130 is preferably made of ebony with a larger than standard bottom surface for more secure attachment to body 20. The larger size of chinrest 130 provides more space and comfort for the chin of the player of electric violin 10. Moreover, chinrest 130 is designed so as to fit in with the modern or "rock" appearance of electric violin 10.

Preferably, electric violin 10 also comprises a nut 140, which corresponds in function to the nut on conventional violins. One desired difference is that nut 140 is most advantageously made of ivory as opposed to ebony on conventional violins, for the durability of ivory over ebony. Moreover, nut 120 is wider than on conventional violins, in order to accommodate the fifth string.

Of course, it is recognized that electric violin of this invention is played with a bow, in a manner similar to that of conventional violins. Either a standard violin bow or a viola bow may be used in the playing of electric violin 10, although the use of a viola bow is preferred. This is due to the advantageous results that can be achieved by use of a viola bow given the proportionally larger size of the preferred embodiments of electric violin 10, when compared to "standard" violins.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

We claim:

1. An electric violin comprising:

(a) a body having an upper end, a first side having upper and lower portions, a lower end and a second side having upper and lower portions, said body shaped so as to comprise a fingerboard indentation along said upper end in a location on one side of a fingerboard extending therefrom, said fingerboard indentation providing sufficient space to permit fingering over a major portion of a fingerboard; a first bow indentation along said first side sized to permit greater space for movement of a bow; and a second bow indentation along said second side sized to permit greater space for movement of a bow;

(b) an unfretted fingerboard having an upper portion and a lower portion, said lower portion mounted on said body and said upper portion extending from said upper end of said body, said fingerboard having sufficient width to accommodate a plurality of strings;

(c) a head disposed on the end of said upper portion of said fingerboard, said head comprising a plurality of pegs, each corresponding to a string;

(d) a plurality of strings, each removably attached to said body, extending along said fingerboard and removably attached to each of said pegs on said head; and (e) a magnetic pickup connectively associated with said body and having an upper portion mounted on said body so as to be operatively connected with each of said plurality of strings to receive sounds therefrom and a lower portion mounted in said body capable of providing the sounds to a suitable amplification means.

2. The electric violin of claim 1 wherein said plurality of strings comprises five strings.

3. The electric violin of claim 2 wherein said strings are made of steel.

4. The electric violin of claim 1 which further comprises a bridge having a top edge which is generally arcuate in shape, wherein said bridge is disposed on said body at a position between where said plurality of strings is removably attached to said body and said magnetic pickup, and wherein said top portion of said bridge is in contact with said plurality of strings to provide a generally arcuate distribution thereto and maintain them in a position wherein they do not press down against any portion of said fingerboard with substantial pressure.

5. The electric violin of claim 4 wherein said upper portion of said pickup is generally arcuate in shape in a stepwise fashion in order to permit a magnetic field generated by said pickup to receive the sounds of each of said plurality of strings when played.

6. The electric violin of claim 1 which further comprises a plurality of individual adjustment controls mounted on said body and functionally connected to said pickup, each corresponding to one of said plurality of strings, each of said individual adjustment controls functioning to permit the adjustment of the volume of the corresponding of said plurality of strings.

7. The electric violin of claim 1 which further comprises an engageable tone-boost control device mounted on said body and functionally connected to said pickup, said tone-boost control device functioning to provide tone boost at roll-off points when engaged.

8. The electric violin of claim 1 which further comprises a master volume control device and a tone control device mounted on said body, each of which is functionally connected to said pickup.

9. The electric violin of claim 1 wherein said head is hexagonal in shape with a first side thereof mounted on said upper portion of said fingerboard; a second side thereof adjacent said first side, said second side comprising an arcuate indentation relative to the hexagon formed by said head; a third side thereof adjacent said second side, said third side extending in a relatively straight line at an obtuse angle relative to said fingerboard; a fourth side adjacent said third side, said fourth side extending in a relatively straight line at an acute angle relative to said third side; a fifth side adjacent said fourth side, said fifth side extending in a relatively straight line at an obtuse angle relative to said fourth side; and a sixth side adjacent and between said fifth side and said first side, said sixth side comprising an arcuate indentation relative to the hexagon formed by said head.

10. The electric violin of claim 1 which further comprises a neck extending from said upper end of said body at the terminal end of which is disposed said head, said neck functioning to support said fingerboard.

11. An electric violin comprising:

(a) a body having an upper end, a first side having upper and lower portions, a lower end and a second side having upper and lower portions, said body shaped so as to comprise a fingerboard indentation along said upper end in a location on one side of a fingerboard extending therefrom; a relatively narrow shaped extension from the upper portion of said first side; a first bow indentation along said first side; a squared-off portion along a lower portion of said first side; an arcuate-shaped lower end; an enlarged and squared-off lower portion of said second side; a second bow indentation along said second side; and an arcuate-shaped upper portion of said second side;

(b) an unfretted fingerboard having an upper portion and a lower portion, said lower portion mounted on said body and said upper portion extending from said upper end of said body, said fingerboard having sufficient width to accommodate five strings;

(c) a hexagonal head disposed on the end of said upper portion of said fingerboard, said head comprising five pegs, each corresponding to a string;

(d) five strings, each removably attached to a stop-tailpiece mounted on said body, extending along said fingerboard and removably attached to each of said pegs on said head;

(e) a stop-tailpiece mounted on said body to which said strings are removably attached;

(f) a bridge having a top edge which is generally arcuate in shape, wherein said bridge is disposed on said body at a position between where said plurality of strings is removably attached to said body and said lower portion of said fingerboard, and wherein said top portion of said bridge is in contact with said plurality of strings to provide a generally arcuate distribution thereto and maintain them in a position wherein they do not press down against any portion of said fingerboard with substantial pressure; and (g) a magnetic pickup connectively associated with said body and having an upper portion mounted on said body between said bridge and said fingerboard so as to be operatively connected with each of said plurality of strings to receive sounds therefrom and a lower portion mounted in said body capable of providing the sounds to a suitable amplification means.

12. The electric violin of claim 11 wherein said strings are tuned in fifths, in order from a first side of said fingerboard to a second side of said fingerboard, "E", "A", "D", "G" and "C".

13. The electric violin of claim 11 wherein said stop-tailpiece is formed of steel with gold overlay.

14. The electric violin of claim 11 wherein said strings are made of steel.

15. The electric violin of claim 11 wherein said upper portion of said pickup is generally arcuate in shape in a stepwise fashion in order to permit a magnetic field generated by said pickup to receive the sounds of each of said plurality of strings when played.

16. The electric violin of claim 11 which further comprises a plurality of individual adjustment controls mounted on said body and functionally connected to said pickup, each corresponding to one of said plurality of strings, each of said individual adjustment controls functioning to permit the adjustment of the volume of the corresponding of said plurality of strings.

17. The electric violin of claim 16 which further comprises an engageable tone-boost control device mounted on said body and functionally connected to said pickup, said tone-boost control device functioning to provide tone boost at roll-off points when engaged.

18. The electric violin of claim 17 which further comprises a master volume control device and a tone control device mounted on said body, each of which is functionally connected to said pickup.

19. The electric violin of claim 11 wherein said hexagonal head comprises a first side thereof mounted on said upper portion of said fingerboard; a second side thereof adjacent said first side, said second side comprising an arcuate indentation relative to the hexagon formed by said head; a third side thereof adjacent said second side, said third side extending in a relatively straight line at an obtuse angle relative to said fingerboard; a fourth side adjacent said third side, said fourth side extending in a relatively straight line at an acute angle relative to said third side; a fifth side adjacent said fourth side, said fifth side extending in a relatively straight line at an obtuse angle relative to said fourth side; and a sixth side adjacent and between said fifth side and said first side, said sixth side comprising an arcuate indentation relative to the hexagon formed by said head.

20. The electric violin of claim 11 which further comprises a neck extending from said upper end of said body at the terminal end of which is disposed said head, said neck functioning to support said fingerboard.

* * * * *